US008410985B2

(12) United States Patent
Mercer et al.

(10) Patent No.: US 8,410,985 B2
(45) Date of Patent: Apr. 2, 2013

(54) MOBILE DEVICE ANTENNA WITH DIELECTRIC LOADING

(75) Inventors: Sean R. Mercer, Issaquah, WA (US); Gerald R. DeJean, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 299 days.

(21) Appl. No.: 12/795,340

(22) Filed: Jun. 7, 2010

(65) Prior Publication Data

US 2011/0298668 A1 Dec. 8, 2011

(51) Int. Cl.
*H01Q 1/24* (2006.01)

(52) U.S. Cl. ..... 343/702; 343/846; 343/700 MS

(58) Field of Classification Search ..... 343/702, 343/846, 700 MS
See application file for complete search history.

(56) References Cited

U.S. PATENT DOCUMENTS

| | | | | |
|---|---|---|---|---|
| 4,447,811 | A | 5/1984 | Hamid | |
| 6,812,891 | B2 * | 11/2004 | Montgomery et al. | 343/700 MS |
| 7,046,197 | B2 * | 5/2006 | Okado | 343/700 MS |
| 7,626,553 | B2 * | 12/2009 | Park et al. | 343/702 |
| 7,746,280 | B2 * | 6/2010 | Kim et al. | 343/702 |
| 2008/0303723 | A1 | 12/2008 | Bengtsson | |
| 2009/0231213 | A1 * | 9/2009 | Ishimiya | 343/702 |
| 2009/0292051 | A1 | 11/2009 | Li et al. | |

OTHER PUBLICATIONS

Dou, "Quad-Band Minimized Antenna Coexistence with Bluetooth for Mobile Application", retrieved on Apr. 8, 2010 at <<http://ieeexplore.ieee.org/stamp/stamp.jsp?tp=&arnumber=1608992&userType=inst>>, IEEE, 2006, pp. 128-131.

Huang, "A Review of Antenna Miniaturization Techniques for Wireless Applications", retrieved on Apr. 7, 2010 at <<http://trs-new.jpl.nasa.gov/dspace/bitstream/2014/12385/1/01-0484.pdf>>, International Conference on Applied Electromagnetics and Communications, Oct. 1, 2001, pp. 1-4.

Kingsley, "Advances in handset antenna", retrieved on Apr. 8, 2010 at <<designhttp://mobiledevdesign.com/hardware_news/radio_advances_handset_antenna/>>, www.rfdesign.com, Microwave/Millimeter Wave Technologies, May 1, 2005, pp. 16-22.

Lee, Abd-Alhameed, Excell, "New Dielectric Resonator Antenna Design for Mobile Handsets", retrieved on Apr. 7, 2010 at <<http://www.ursi.org/Proceedings/ProcGA05/pdf/BP.10(01068).pdf>>, pp. 1-4.

Lin, Chen, Lin, Pan, "Planar Inverted-L Antenna With a Dielectric Resonator Feed in a Mobile Device", retrieved on Apr. 8, 2010 at <<http://ieeexplore.ieee.org/stamp/stamp.jsp?tp=&arnumber=5196755>>, IEEE Transactions on Antennas and Propagation, vol. 57, No. 10, Oct. 2009, pp. 3342-3346.

(Continued)

*Primary Examiner* — Hoang V Nguyen
(74) *Attorney, Agent, or Firm* — Lee & Hayes, PLLC

(57) ABSTRACT

Mobile device antennas with dielectric loading are described herein. In one example, a mobile device includes a ground plane, carried within an enclosure. An antenna is connected to the ground plane. Dielectric loading material is provided within at least a portion of an area defined between the ground plane and the antenna. The dielectric loading material results in a shortening of a required antenna length, thereby creating a recovered area, i.e., valuable space within the enclosure "recovered" by the use of dielectric loading material.

18 Claims, 7 Drawing Sheets

OTHER PUBLICATIONS

Tamaoka, Hamada, Ueno, "A Multiband Antenna for Mobile Phones", retrieved on Apr. 7, 2010 at <<http://www.furukawa.co.jp/review/fr026/fr26_03.pdf>>, Furukawa Review, No. 26, 2004, pp. 12-16.

Tefiku, "A Dual-Band GPS/BT Antenna with Low Coupling to a Cellular Antenna for Mobile Phones", retrieved on Apr. 8, 2010 at <<http://ieeexplore.ieee.org/stamp/stamp.jsp?tp=&arnumber=461945>>, IEEE Antennas and Propagation Society International Symposium, Jul. 5, 2008, pp. 1-4.

* cited by examiner

MOBILE DEVICE ANTENNA WITH DIELECTRIC LOADING

BACKGROUND

Mobile phones and other wirelessly enabled devices continue to shrink in size, or are required to accommodate more functionality into existing form factors. Efficient antenna operation, providing adequate RF bandwidth and gain, is problematic in such environments. Many devices are required to contain more than one antenna and communicate over several different frequencies. Moreover, challenging performance standards may be imposed by regulatory bodies, cellular carriers and/or the dynamics of the marketplace.

Antenna designers are frequently pushed to conform to a plurality of stringent—and possibly inconsistent—design parameters, regarding antenna size, performance and other factors. Accordingly, advancements in antenna design would assist antenna designers and would result in mobile phones and other wirelessly enabled devices that conform to their product requirement specifications.

SUMMARY

Techniques for enhancing mobile device antenna performance by application of dielectric loading materials are described herein. In one example, a mobile device includes a ground plane carried within an enclosure. An antenna is connected to the ground plane. Dielectric loading material is provided within at least a portion of an area defined between the ground plane and the antenna. The dielectric loading material results in a shortening of a required antenna length, thereby creating a recovered area, i.e., valuable space that is "recovered" by the use of dielectric loading material. The recovered area can be put to one or more uses. For example, a smaller antenna may make it possible to provide a desired separation space between the antenna and the enclosure. Such a separation space may prevent or reduce adverse hand detuning, which may otherwise result when a user touches the enclosure. Alternatively or additionally, a smaller antenna may allow installation of components (e.g., active components, such as integrated circuits) installed within the recovered area, thereby providing additional functionality to the mobile device. And further, a smaller antenna may simply allow the enclosure of the mobile device to be smaller.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The term "techniques," for instance, may refer to device(s), system(s) and/or method(s) as permitted by the context above and throughout the document.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components. Moreover, the figures are intended to illustrate general concepts, and not to indicate required and/or necessary elements.

DETAILED DESCRIPTION

Figure 1:
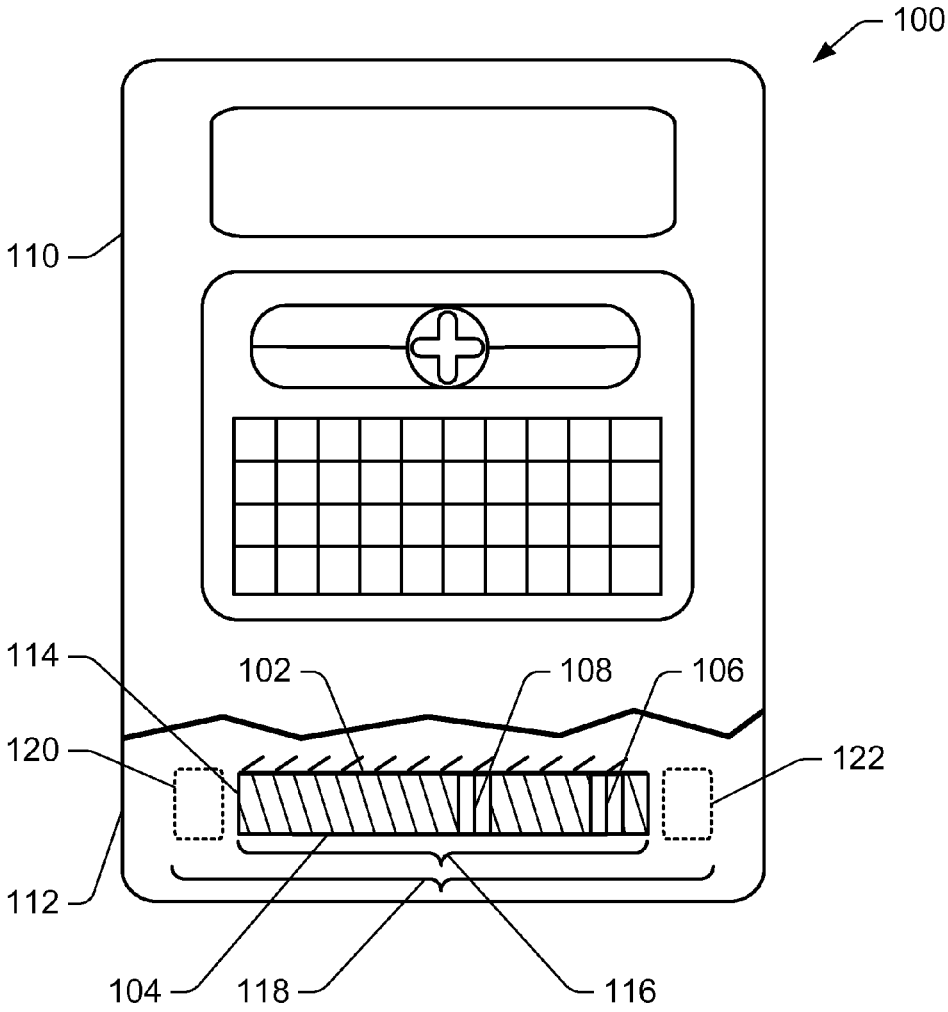
FIG. 1 is an example of a mobile device having an antenna configured with dielectric loading material.

The recovered areas can be utilized in one or more manners. For example, reduced antenna length may make it possible to increase distance between the antenna and enclosure. This may prevent or reduce adverse detuning, which may otherwise result when a user touches the enclosure. A smaller antenna may allow installation of components into a recovered area, thereby providing additional functionality to the mobile device. And further, a smaller antenna may simply allow the enclosure of the mobile device to be smaller.

The recovered areas can be utilized in one or more manners. For example, reduced antenna length may make it possible to increase distance between the antenna and enclosure. This may prevent or reduce adverse detuning, which may otherwise result when a user touches the enclosure. A smaller antenna may allow installation of components into recovered area, thereby providing additional functionality to the mobile device. And further, a smaller antenna may simply allow the enclosure of the mobile device to be smaller.

In one arrangement, an antenna may be supported above a ground plane that is within a printed circuit board (PCB). Dielectric loading material may be located between all or part of the antenna and the PCB. The antenna and dielectric loading material can be kept in place by any appropriate fasteners, such as adhesive glue, clips, heat stakes or other fastening devices, both known and developed for the application. In a further commonly practiced arrangement, the antenna may be implemented as a film or flexible PCB element and carried by, located along side or adjacent to, and/or wrapped about component(s), such as a plastic carrier frame. Such antennas, when somewhat shortened by the use of dielectric loading material, can be positioned further from the enclosure (and thereby in a location less susceptible to adverse hand detuning). In a still further and increasingly common arrangement, the antenna may be printed onto the plastic carrier frame of the mobile device. By appropriately locating dielectric loading material, such antennas may be made more compact, while retaining specification compliance.

In a variation of the antenna dielectric structure discussed above, a second dielectric loading material component can be located adjacent to the antenna, and on a side of the antenna opposite the first dielectric loading material, discussed above. Accordingly, a portion of the antenna may sandwiched between two dielectric loading material components, to thereby provide greater reduction in antenna size, while maintaining specification compliance.

And in a further variation, dielectric loading material can be located between the antenna and a portion of the enclosure nearest to the antenna. This arrangement can reduce adverse hand detuning in particular applications.

The discussion herein includes several sections. Each section is intended to be non-limiting; more particularly, this entire description is intended to illustrate components, techniques and arrangements which may be utilized in dielectric loading of mobile device antennas. The sections are not intended to illustrate components which must be utilized in any particular application. The discussion begins with a section entitled "Mobile Device Antennas with Dielectric Loading" describes aspects which provide improved antenna performance by using dielectric loading materials. A section entitled "Dielectrically Loading Both Sides of an Antenna" describes an optional step beyond dielectrically loading one side of an antenna. A section entitled "Dielectric Loading to Reduce Hand Detuning" describes techniques that may be used to further reduce the symptoms of antenna detuning due to contact between the device enclosure and outside objects, such as a user's hand. A section entitled "Flexible PCB and Printed Antennas" describes techniques applicable to these types of antennas. A section entitled "Example Antenna Configurations" describes antennas having differently sized and positioned dielectric elements. Finally, the discussion ends with a brief conclusion.

This brief introduction, including section titles and corresponding summaries, is provided for the reader's convenience and is not intended to limit the scope of the claims, nor the proceeding sections.

Mobile Device Antennas with Dielectric Loading

FIG. 1 is an example of a mobile device (e.g., a cellular telephone or other wireless communications device) 100 having an antenna configured with dielectric loading material, as depicted in a cutaway portion of mobile device 100. Use of dielectric loading material results in a smaller antenna configuration, reduces susceptibility to adverse hand detuning, allows use of a smaller enclosure and/or allows space for additional components and a corresponding increase in functionality of the mobile device.

The mobile device 100 may include a number of components. Many mobile devices contain a printed circuit board (PCB), which provides connectivity to the components. In many applications, the PCB additionally provides a ground plane 102 for the mobile device 100. An antenna 104 is supported a distance from the ground plane 102. In some embodiments, a shorting element or ground connection 106 provides an electrical connection between the ground plane 102 and the antenna 104. For example, the ground connection 106 may be used in inverted F or planar inverted F [PIFA] antenna topologies and some loop antenna topologies. Monopole antenna topologies do not require a ground connection. Accordingly, inclusion of the ground connection 106 depends on a design or topology of the antenna 104. Moreover, the techniques discussed herein regarding use of dielectric loading material are adaptable to most antenna topologies, including antenna topologies with and without ground connections. A feed line 108 may be used to drive the antenna. Depending on the antenna design, the feed line 108 may include two conductors, one of which is connect to each of the ground plane 102 and the antenna 104. An enclosure 110, shown to have arbitrary screen, keyboard and user interface devices, is provided as an example only, and should not be considered to contain required components, features and/or elements.

Significantly, the antenna 104 may be implemented using any desired technology, topology, design and/or materials. An antenna may be selected based on design requirements, costs or other parameters associated with a particular project. Examples of antenna technologies—intended not as a comprehensive list, but for purposes of illustration—include antennas formed as metal printed onto substrates or plastics, antennas formed as conductors in flexible self adhesive films on substrates, and antennas formed as stamped metal elements in an appropriate shape. Accordingly, antenna 104 should be considered to be somewhat diagrammatic in nature, and as such, representative of a wide range of antenna technologies.

Dielectric loading material 114 is located and contained within at least a portion of a region between the ground plane 102 and the antenna 104. The antenna 104, dielectric loading material 114 and ground plane 102 may therefore assume a stacked relationship, with the dielectric loading material sandwiched between the antenna 104 and ground plane 102. The dielectric loading material may be any dielectric material suggested by a particular design. For example, ceramic materials in sheet form provide suitable dielectric properties for many designs. Additionally, dielectric materials in sheet form, such as RF (radio frequency) substrate materials may be used. Such materials are available from vendors, including Taconics (Taconics Headquarters, Advanced Dielectric Division, 136 Coonbrook Road, Petersburgh, N.Y. 12128, USA) or Rogers (Rogers Corporation, One Technology Drive, Rogers, Conn. 06263).

Use of the dielectric loading material 114 within all or part of the region between the ground plane 102 and the antenna 104 allows design and fabrication of an antenna 104 of shorter length 116, as seen in FIG. 1. Without the use of such dielectric loading material 114, the length of the antenna 104 might be a longer length 118 to obtain essentially equivalent performance. Note that shorter length 116 and longer length 118 are for purposes of illustration, and not necessarily to scale. However, the difference between shorter length 116 and longer length 118 indicate that use of dielectric loading material 114 shortens the antenna 104. In particular, an antenna 104 of shorter length 116 may not function as desired—i.e., at an intended frequency of operation, gain and/or according to an intended compliance specification—without use of dielectric loading material 114. Accordingly, a larger region associated with longer length 118 may be required for operation of an antenna without the use of dielectric loading material. However, an antenna having the longer length 118 may violate design parameters, and include problems such as adverse hand detuning, and may require space needed for other components.

By using dielectric loading material 114 within all or part of the region between the ground plane 102 and the antenna 104—resulting in an antenna 104 sized for location within a region of shorter length 116—recovered areas 120 and 122 are obtained. Accordingly, an antenna can be sized—and recovered areas 120, 122 created—in part as a function of the nature, type, size and positioning of the dielectric loading material 114. The recovered areas 120, 122 can be utilized in one or more manners. For example, the recovered areas 120, 122—associated with an antenna 104 and dielectric loading material 114 sized to fit within an area of shorter length 116—may provide sufficient separation between the antenna 104 and enclosure 110 to prevent or reduce adverse detuning. For example, user contact with location 112 of the enclosure 110 may not result in detuning if recovered areas 120, 122 are created through the use of dielectric loading material 114. Moreover, an antenna 104 utilizing dielectric loading material 114 may allow installation of components (e.g., active components such as integrated circuits) into recovered area, thereby providing additional functionality to the mobile device 100. And further, an antenna 104 utilizing dielectric loading material 114 may allow the enclosure 110 of the mobile device 100 to be smaller.

The point at which feed line 108 is connected to the PCB, within which the ground plane 102 is located, may be considered to be a design parameter. In particular, by selecting a point at which the feed line 108 attaches to the PCB, the relative sizes of the recovered areas 120, 122 may be adjusted. For example, if a ground plane within the PCB is generally co-extensive with the PCB, then attachment of the feed line 108 to a central location on the PCB will result two similarly sized recovered areas. As a further example, attachment of the feed line to an off-center location on the PCB will result in one recovered area that is larger than the other recovered area. As a still further example, attachment of the feed line to a location near one edge of the PCB will result in one recovered area that is much larger than the other recovered area. Thus, while in the example of FIG. 1 the recovered areas are illustrated to be similar in size, in other embodiments the recovered areas could be differently sized, or one recovered area could be eliminated in favor of enlargement of the other.

Figure 2:
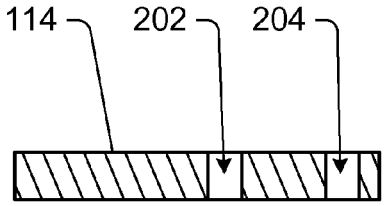
FIGS. 2 and 3 illustrate side orthographic and plan views, respectively, of the dielectric loading material of FIG. 2.
Figure 3:
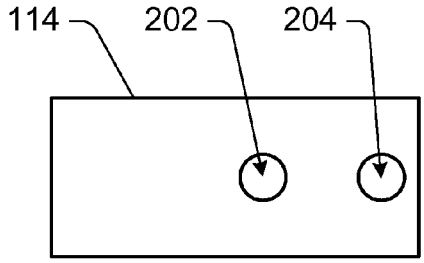

FIG. 2 illustrates a side orthographic view of the dielectric loading material 114 of FIG. 2. The dielectric material illustrated is as sheet material, but is representative of any desired dielectric material. Holes 202, 204 allow for passage of the feed line 108 (see FIG. 1) and the ground connection 106 (see FIG. 1), respectively. FIG. 3 illustrates a plan view of the dielectric loading material of FIG. 1. In the illustrated example, dielectric loading material may be a generally rectangular block of material having holes 202, 204 formed therein to accommodate feed line 108 and ground connection 106, respectively. While FIGS. 2 and 3 illustrates holes 202, 204 defined in the dielectric loading material 114 for passage of a ground connection 106 and a feed line 108, these conductors do not require holes defined in the dielectric loading material 114. For example, these conductors may alternatively be oriented along an edge of the dielectric loading material 114. Moreover, holes 202, 204 and/or additional holes may also be included in the dielectric material 114 for mounting purposes, e.g., for heat staked plastic pillars to secure the dielectric material in position.

Figure 4:
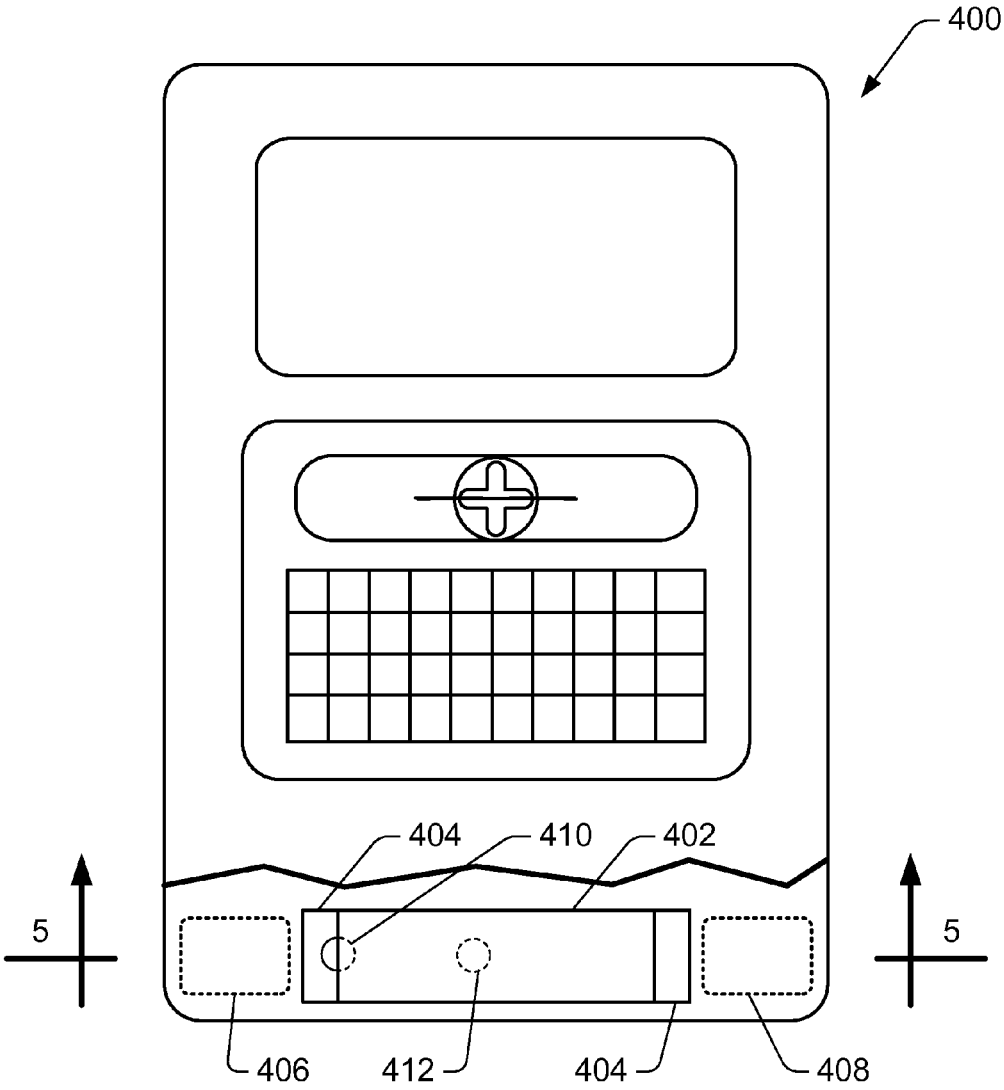
FIG. 4 is an example of a mobile device similar to that of FIG. 1, but wherein the antenna with dielectric loading is differently oriented.

FIG. 4 is an example of a mobile device (e.g., a cellular telephone or other wireless communications device) 400 similar to that of FIG. 1, but wherein the antenna with dielectric loading is differently oriented. Referring to FIG. 4, the mobile device 400 includes an antenna 402 adjacent to dielectric loading material 404. Two recovered areas 406, 408 result from the utilization of dielectric loading material 404, i.e., without the use of dielectric loading material 404, the antenna 402 would extend into the recovered areas 406, 408.

Figure 5:
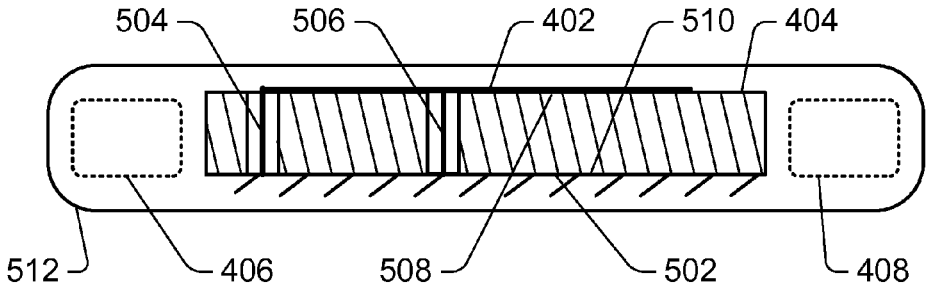
FIG. 5 illustrates a cross-sectional view of the mobile device of FIG. 4, taken across the 5-5 lines of FIG. 4.

Two holes 410, 412 may be defined in the dielectric loading material 404, as one option to provide passage for a ground connection (as seen in FIG. 5) and a feed line (as seen in FIG. 5) between the antenna 402 and a ground plane (as seen in FIG. 5). As noted above with respect to FIGS. 2 and 3, these holes and/or additional holes, may be used for mounting and/or fastener purposes.

FIG. 5 illustrates a cross-sectional view of the mobile device of FIG. 4, taken across the 5-5 lines of FIG. 4. In particular, a ground plane 502 is typically part of a printed circuit board (PCB), and provides an electrical ground for components within the mobile device. The antenna 402 is supported above the ground plane 502. Dielectric loading material 404 is located within all or part of a portion of the area between the antenna 402 and the ground plane 502. In some embodiments, a ground connection 504 provides an electrical connection between the antenna 402 and ground plane 502. For example, the ground connection 504 may be used in inverted F or planar inverted F [PIFA] antenna topologies and some loop antenna topologies. Monopole antenna topologies do not require ground connection 504; accordingly, ground connection 504 is not provided in some embodiments. Moreover, the techniques discussed herein regarding use of dielectric loading material are intended for application to all of these antenna topologies, including both those with and without ground connections. A feed line 506 may include two electrical conductors, and provide signals to both the antenna 402 and ground plane 502. The antenna 402, dielectric loading material 404 and ground plane 502 may be secured together in any desired manner, such as in a stacked relationship, by any suitable fastener. For example, a film of adhesive fastener 508, 510 may be used to secure the top and bottom of the dielectric loading material to antenna 402 and the ground plane 502, respectively. Other fasteners or fastening strategies, such as friction-fit, heat-staking or clips may alternatively be used. The recovered areas 406, 408 result in greater spacing between the antenna 402 and a portion of the enclosure 512 than would result without the use of dielectric loading material 404. Accordingly, user contact—such as by holding and touching the mobile device—does not result in adverse hand detuning.

Figure 6:
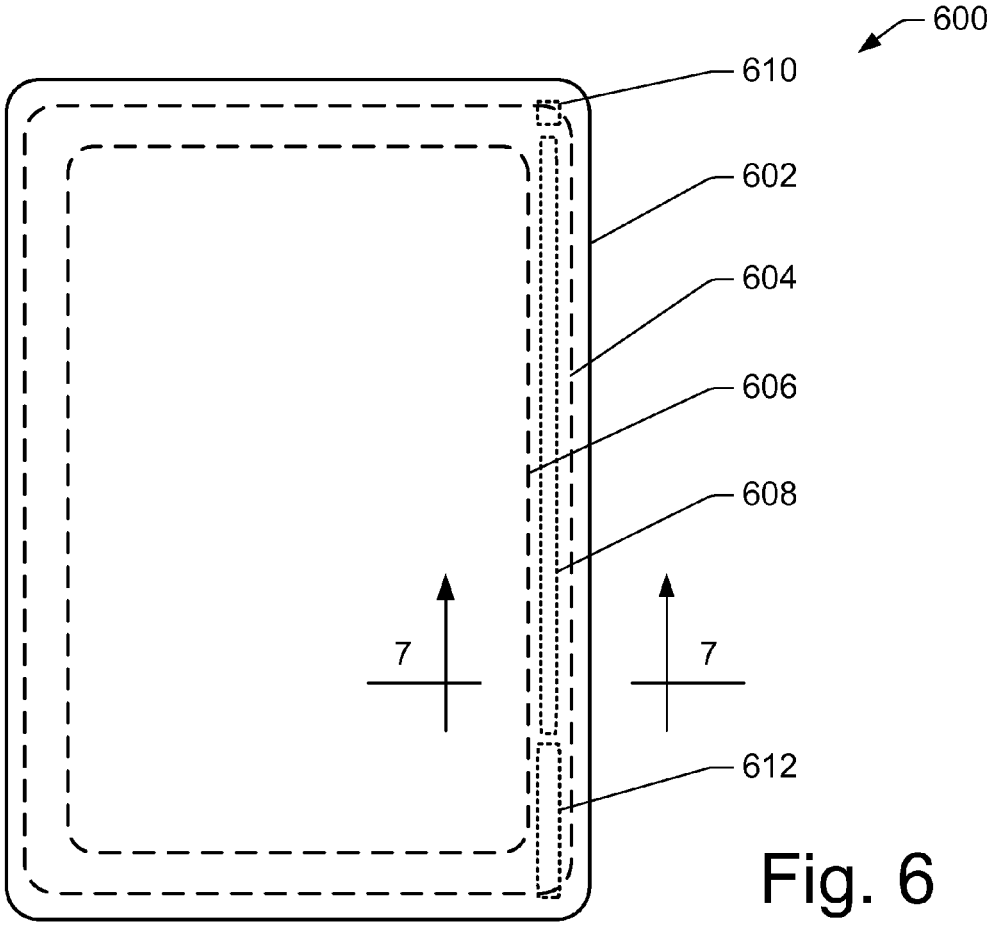
FIG. 6 is cut-away plan view of a mobile device, illustrating an enclosure and a carrier frame within the enclosure.

FIG. 6 is plan view of a mobile device 600, illustrating an enclosure 602, a carrier frame 604 and a PCB 606 within the enclosure. While enclosures and carrier frames are discussed herein, it should be noted that an enclosure and a carrier frame can be unified into a single component, in some applications. The mobile device 600 is intended as an example only, and to be representative of a wide array of devices, including mobile phones having an enclosure and internal frame. Such internal frames may include one or more components (e.g., a "clamshell" design), and provide support and attachment for one or more internal components, such as printed circuit boards, connectors, switches, a battery and the like.

An antenna and dielectric region 608 encompasses an antenna associated with one or more dielectric loading material(s) in one or more locations. The dielectric loading material(s) used within the antenna and dielectric region 608 results in a shorter antenna than would be the case without use of dielectric loading material. Accordingly, use of dielectric loading material within the antenna and dielectric region 608 may result in recovered areas 610, 612, i.e., areas that represent a degree to which the antenna with dielectric loading material is shorter than an antenna without dielectric loading material. The relative sizes of the recovered areas 610, 612 may be adjusted. For example, one recovered area may be made larger and the other recovered area made correspondingly smaller by variation of a point at which a feed line driving the antenna is attached to a printed circuit board and associated ground plane. Thus, while in the example of FIG. 6 the recovered area 610 is shown to be smaller in size than recovered area 612, in other embodiments the recovered areas could be similarly sized, or one recovered area could be completely, or almost completely, eliminated in favor of enlargement of the other.

Figure 7:
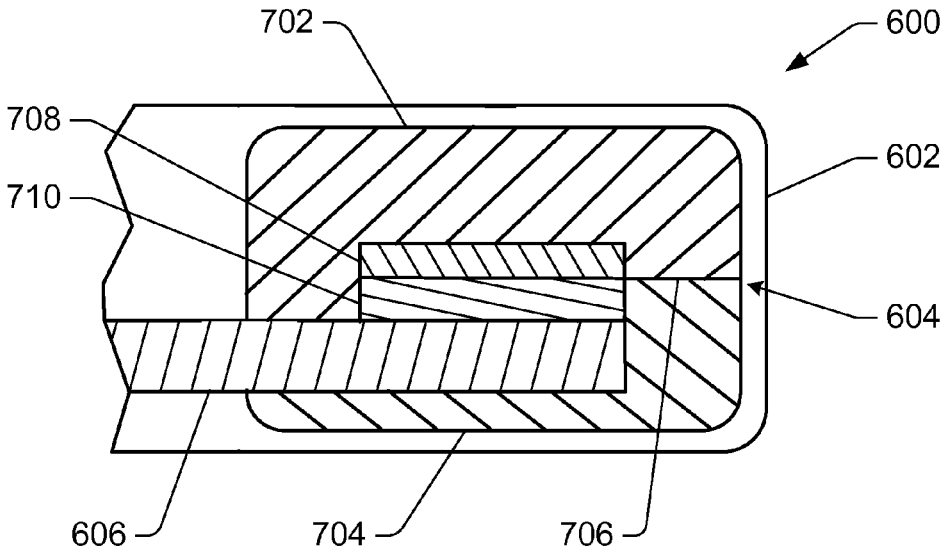
FIG. 7 illustrates a cross-sectional view of the mobile device of FIG. 6, taken along lines 7-7 of FIG. 6, showing a view of the printed circuit board, antenna, dielectric loading material and carrier frame.

FIGS. 7-11 represent five mobile devices illustrating alternative versions of the structure of the enclosure 602, carrier frame 604, PCB 606 and antenna and dielectric region 608 of the mobile device 600 of FIG. 6. In a first example, FIG. 7 illustrates a cross-sectional view of the mobile device 600, taken across the 7-7 lines of FIG. 6. A cross-sectional view of the enclosure 602, the carrier frame 604 and the PCB 606 are shown. For purposes of example only, and not intended as a required or preferred means of construction, the carrier frame 604 is shown having a clamshell design, including an upper portion 702 and a lower portion 704. A fastened or welded area 706 attaches the upper portion 702 and lower portion 704. The printed circuit board 606 provides a ground plane to one or more components within the enclosure 602. An antenna 708 is supported above the printed circuit board 606 and associated ground plane within the carrier frame 604. A portion of an area between the antenna 708 and printed circuit board 606 is filled with dielectric loading material 710. In one example, the printed circuit board 606, antenna 708 and dielectric loading material 710 may be located within slots and/or areas defined by one or both portions 702, 704 of the carrier frame 604 prior to assembly of the carrier frame, i.e., prior to connection of the portions 702, 704 at area 706. Thus, the structure of FIG. 7 is intended to be representative of a wide range of construction techniques.

Dielectrically Loading Both Sides of an Antenna

Figure 8:
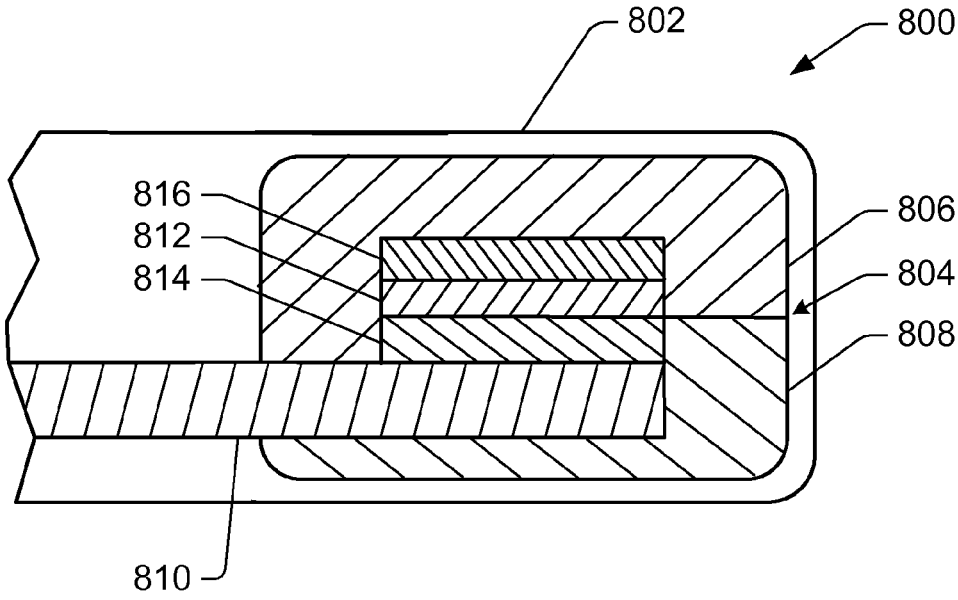
FIG. 8 is a view similar to that of FIG. 7, showing a mobile device additionally having dielectric material on both sides of the antenna.

FIGS. 1, 4, 5 and 7, and associated discussion, have related to antennas having dielectric loading material on a single side of the antenna. In some designs, construction of such an antenna is more economical than construction of an antenna with dielectric loading material on both sides of the antenna. However, in other designs, it is desirable to provide at least some dielectric loading material on both sides of the antenna. In such designs, application of dielectric material to both sides of an antenna can result in further size reduction of the antenna. FIG. 8 provides an example of an antenna, such as an antenna in a mobile device (e.g., a cellular telephone), having dielectric loading material located on at least part of both sides of the antenna.

FIG. 8 is a cross-sectional view similar to that of FIG. 7, but differing in that the mobile device 800 of FIG. 8 discloses an optional use of dielectric material on both sides of the antenna. In particular, the mobile device 800 includes an enclosure 802 and a carrier frame 804 having upper and lower portions 806, 808. A print circuit board 810 having a ground plane is supported by the carrier frame 804. An antenna 812 is located above the printed circuit board 810. At least some of a region between the printed circuit board 810 and the antenna 812 is filled with a first dielectric loading material 814. Additionally, a second dielectric loading material 816 is located adjacent to the antenna 812, and on a side of the antenna 812 opposite the first dielectric loading material 814. Thus, recovered areas (e.g., as seen in FIGS. 1 and 4-6) can be created, in part as a function of the nature, type, size and positioning of the first and/or second dielectric loading materials 814, 816. Accordingly, at least a portion of the antenna 812 may be sandwiched between the first dielectric loading material 814 and the second dielectric loading material 816. Note that the design requirements of any given mobile device can vary, due to product requirements, specification compliance and other factors. Thus, while some or all of opposed sides of the antenna may include dielectric loading material, it may be advantageous that some of the antenna does not have dielectric loading material on one or both sides.

Dielectric Loading to Reduce Hand Detuning

Figure 9:
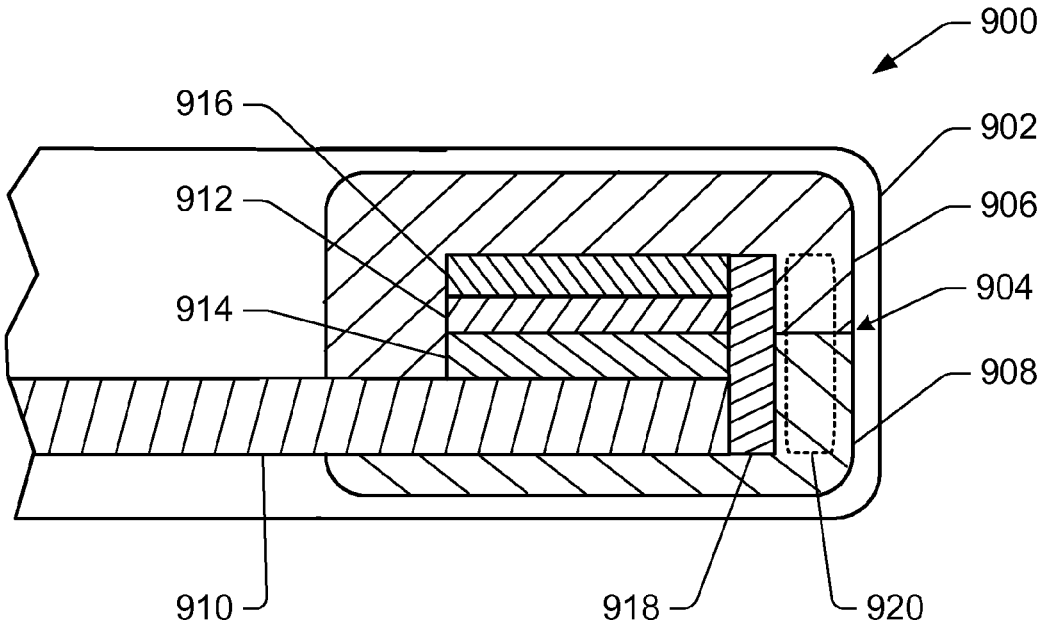
FIG. 9 is a view similar to that of FIG. 8, showing a mobile device additionally having dielectric loading material located between the antenna and a portion of the enclosure near the antenna.

FIGS. 1-8 have disclosed aspects indicating that application of dielectric material on one or both sides of an antenna may result in "recovered areas" within the enclosure of a mobile device. Moreover, these figures and associated discussion have indicated that where the recovered areas are of sufficient size and a layout of components within the mobile device is advantageous, adverse hand detuning is reduced and/or eliminated. However, in some applications, addition attention to adverse hand detuning may be advantageous. FIG. 9 illustrates an example of dielectric loading specifically indicated to address adverse hand detuning.

FIG. 9 is a cross-sectional view similar to that of FIG. 8, but additionally showing a mobile device 900 additionally having dielectric loading material located between the antenna and a portion of the enclosure nearest to the antenna. Accordingly, FIG. 9 addresses aspects of controlling adverse hand detuning.

Referring to FIG. 9, an enclosure 902 houses a carrier frame 904. In the example shown, the carrier frame 904 includes an upper portion 906 and a lower portion 908, which can be fused, welded, glued or similarly connected. Alternatively, the carrier frame 904 can be constructed of a single piece, or additional pieces, as indicated in response to design parameters of a particular mobile device. The carrier frame may support a printed circuit board 910, having a ground plane, typically as one layer in a multilayer board. An antenna 912 is supported off the printed circuit board 910. All or part of a space between the antenna 912 and the printed circuit board 910 can be filled with a first dielectric loading material 914. In the example shown, some or all of a side of the antenna 912 opposite the first dielectric loading material 914 may be covered with a second dielectric loading material 916. Alternatively, the second dielectric loading material 916 may not be required.

FIG. 9 additionally shows a further dielectric loading material 918. This dielectric loading material 918 may be the first, second or third, depending on the presence or absence of dielectric loading materials 914 and 916. The dielectric loading material 918 may be located between the antenna 912 and a portion of the enclosure 902 nearest to the antenna 912. This design provides additional protection against adverse hand detuning. In particular, a recovered area 920 results from the use of dielectric loading material 918. In some applications, the recovered area 920 may allow the antenna 912 to be smaller and/or located further from the enclosure 902. Alternatively and/or additionally, the recovered area may result in better isolation of the antenna 912, and reduced adverse hand detuning of the antenna 912, even when the antenna size and/or location is not changed by the addition of dielectric loading material 918.

Flexible PCB and Printed Antennas

Figure 10:
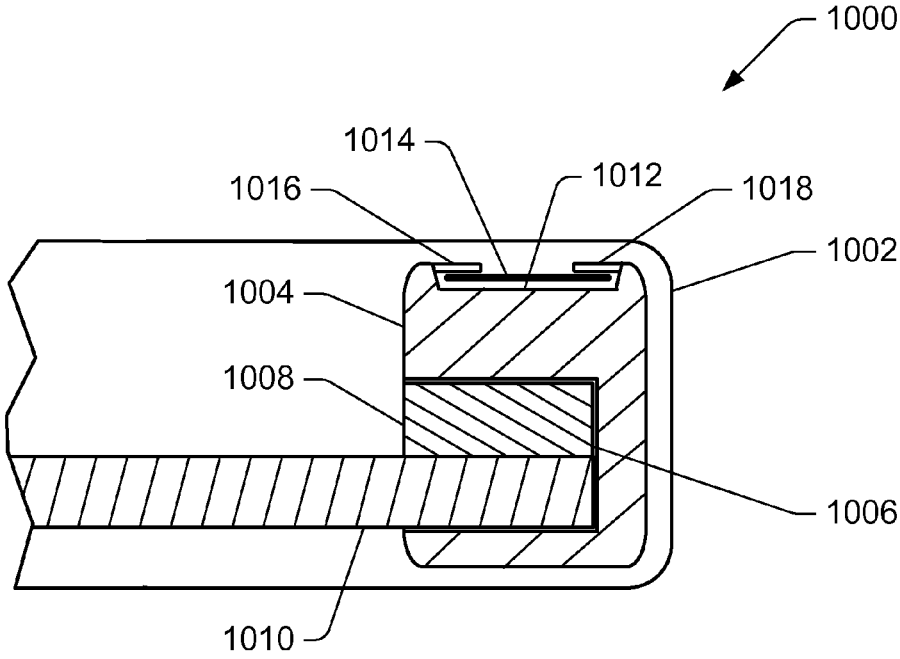
FIG. 10 is a view similar to that of FIG. 7, illustrating aspects of thin film and/or printed type antennas.
Figure 11:
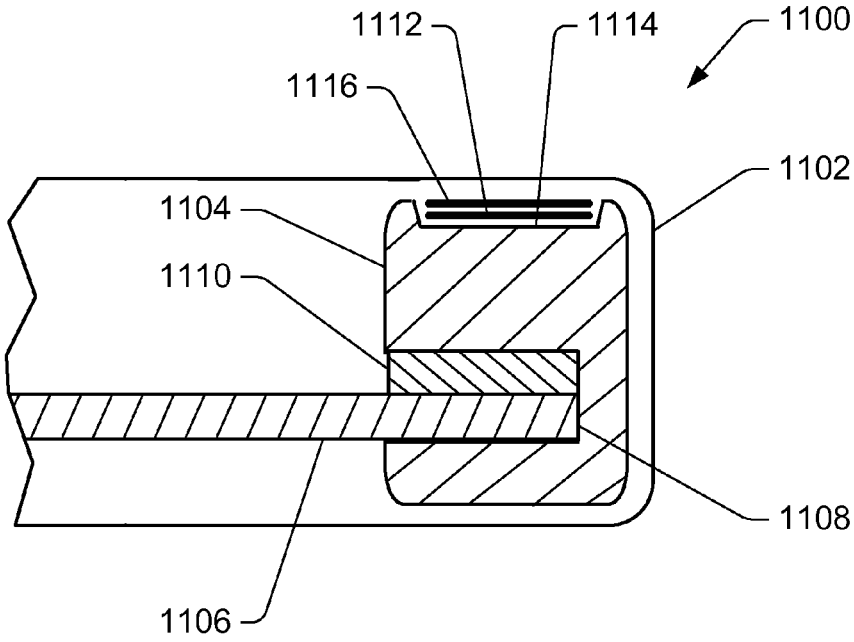
FIG. 11 is a view similar to that of FIG. 10, additionally showing a portion of the antenna sandwiched between dielectric loading materials.

FIGS. 1-9 have described aspects of mobile device antennas with dielectric loading in generic terms, and have thereby discussed aspects relevant to antennas generally. FIGS. 10 and 11 discuss implementations directed to widely adopted flexible film PCB antennas and antennas printed on a substrate, such as a carrier frame of a mobile device. Thus, FIGS. 10 and 11 are both directed to both flexible film and printed antennas specifically, but also to general principles applicable to a wider array of antennas.

FIG. 10 is a cross-sectional view similar to that of FIGS. 7-9. FIG. 10 illustrates an antenna 1014 that may be either a thin film PCB antenna or a printed-on antenna. A thin film PCB antenna is typically wrapped about, or carried next to, the carrier frame 1004. A printed antenna may be printed directly on the carrier frame 1004 or the inside of the enclosure 1002.

In particular, a mobile device 1000 includes an enclosure 1002. A carrier frame 1004 may be made of plastic or other material, as indicated by a particular set of design requirements. In an example implementation, a notch 1006 may be defined in the carrier frame 1004 to support dielectric loading material 1008 and a PCB 1010 having a ground plane.

A second recess or notch 1012 may optionally be defined in the carrier frame 1004 to define a location within which a flexible thin film PCB antenna 1014 is carried. The flexible thin film PCB antenna 1014 may be attached to the carrier frame 1004 by any desired fastener, such as flange fasteners 1016, 1018, adhesive or simply frictional fastening, which secures the flexible thin film PCB antenna 1014 between the carrier frame 1004 and the enclosure 1002. The flexible thin film PCB antenna 1014 may be located along, or carried by, one or more sides of the carrier frame 1004—as seen in FIG. 10. In applications where the flexible thin film PCB antenna 1014 is longer and/or dimensions of the carrier are shorter, the thin film PCB antenna may be wrapped about two or more sides of the carrier frame, depending on a desired positioning of the antenna and on relative lengths of the antenna and the carrier frame.

Alternatively, the antenna 1014 of FIG. 10 may be of a printed-on construction—that is, the antenna 1014 may be printed onto the carrier frame 1004 or other desired substrate. Such a printed antenna may include a printed element pattern indicated by design requirements of a particular application/design. Accordingly, the antenna 1112 of FIG. 10 is representative of flexible thin film PCB antennas, printed antennas and other antennas. In the example of FIG. 11, the antenna 1112 is shown wrapped-about or printed-on only an upper portion of the carrier frame 1104; however, the antenna could alternatively extend about additional portions of the carrier frame. Generally, antennas intended for operation at lower frequencies may be wrapped or printed on greater portions of the carrier frame 1104.

FIG. 11 is a view similar to that of FIG. 10. In particular, a mobile device 1100 includes an enclosure 1102, a carrier frame 1104 and a printed circuit board 1106. The carrier frame 1104 may define a channel, slot or notch 1108 within which the printed circuit board 1106 and a first dielectric loading material 1110 are carried. The first dielectric loading material 1110 may be fastened within the carrier frame 1104 in any appropriate manner, such as fasteners, plastic clips, heat stakes, adhesive, friction and/or other fastener types.

An antenna 1112 may be supported by the carrier frame 1104. Optionally, the antenna may be supported within a second notch 1114 defined on the surface of the carrier frame 1104. The antenna may be secured in place by a small quantity of adhesive, a pin, a clip, heat-welding or other fastening means.

FIG. 11 additionally illustrates a second dielectric loading material 1116, which may be located on a side of the antenna 1112 opposite the first dielectric loading material 1110. The second dielectric loading material may be held in place by fasteners, plastic clips, heat stakes, adhesive, friction and/or other fastener types. In the event that the second dielectric loading material 1116 is used, the second notch 1114 may be sized to recess both the antenna 1112 and second dielectric loading material 1116 within the carrier frame 1104.

Example Antenna Configurations

Figure 12:
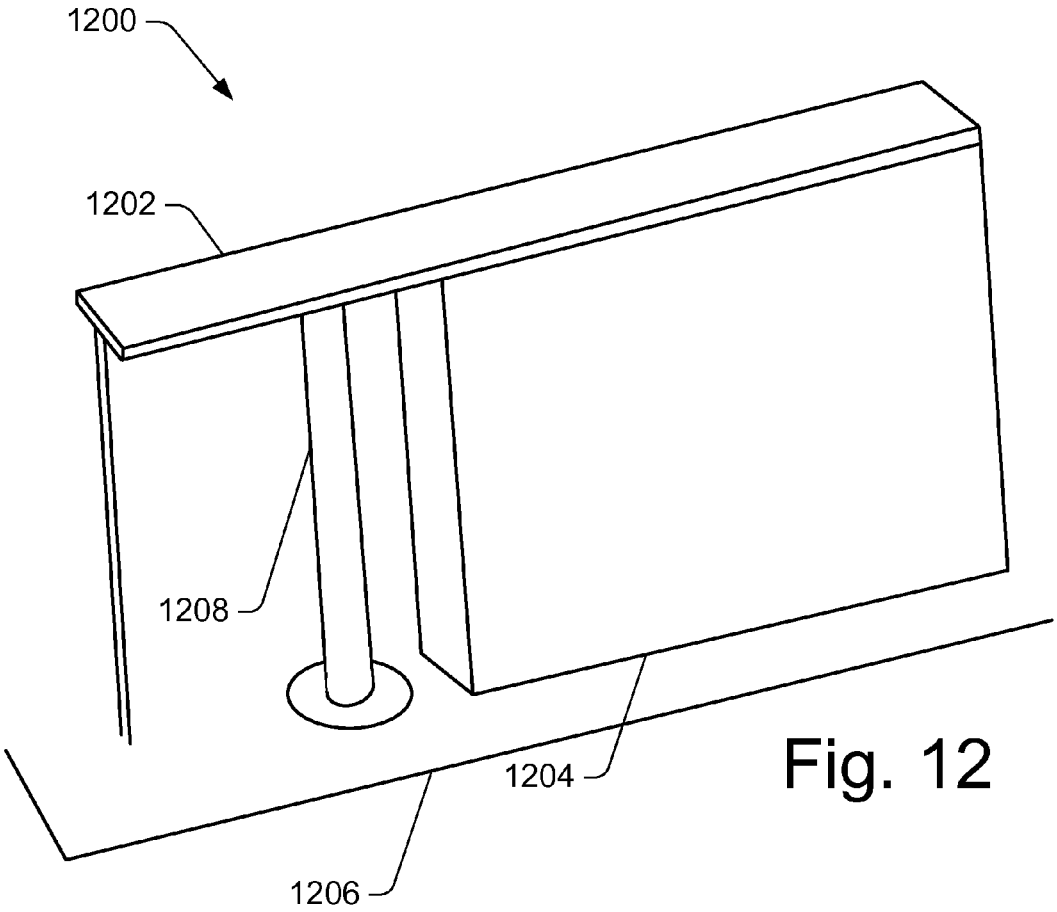
FIGS. 12-14 are perspective views showing three examples of antennas having differently sized and positioned dielectric elements.
Figure 13:
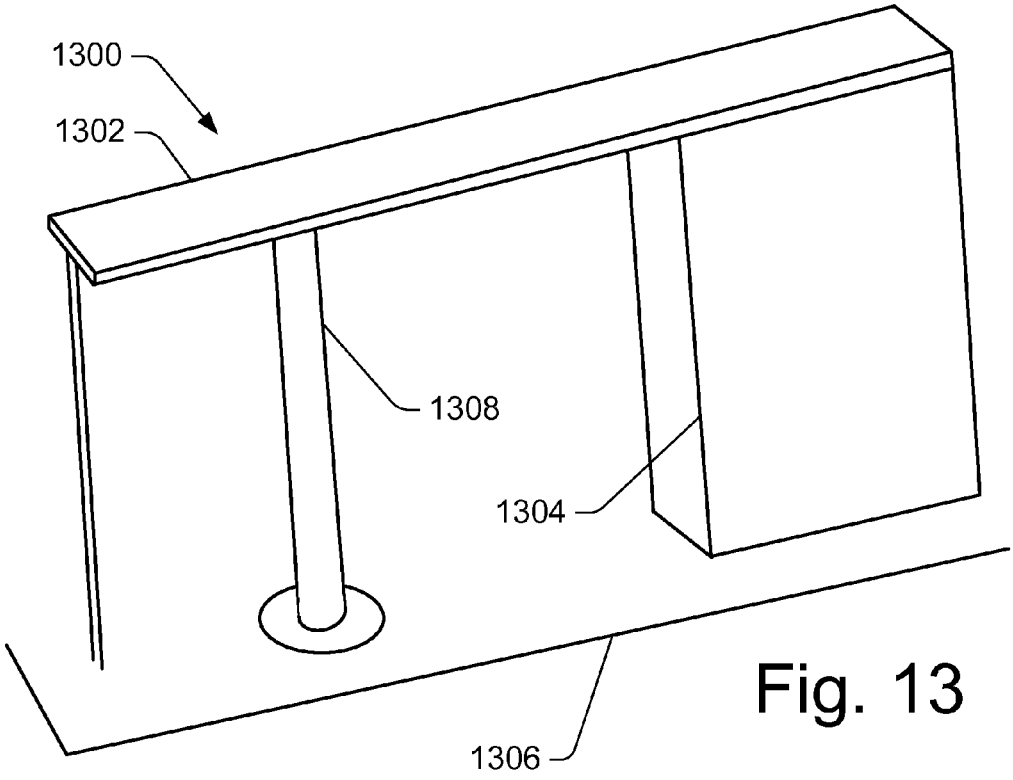
Figure 14:
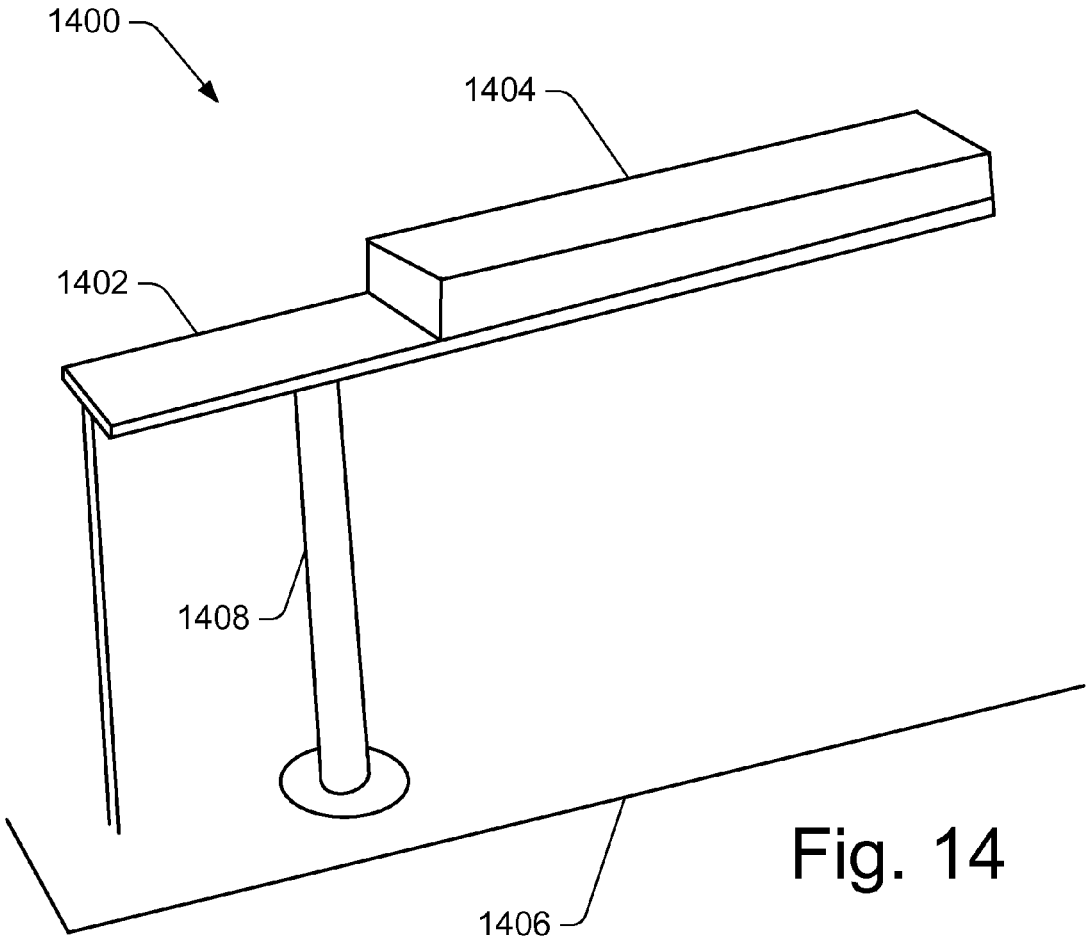

FIGS. 12-14 illustrate three example antennas having different configurations, including differently sized and positioned dielectric elements. FIGS. 12 and 13 illustrate examples of differently sized dielectric elements positioned between an antenna and a ground plane. FIG. 14 illustrates an example of an antenna having a dielectric element on a side of the antenna opposite the ground plane. The dimensions, frequencies, dielectric constants and other values discussed herein are for purposes of illustration only, and are not meant to in any way limit the concepts discussed. Instead, the specific values are intended only to provide representative designs illustrating techniques discussed herein. Additionally, FIGS. 12-14 are not drawn to scale, but are drawn to illustrate concepts discussed herein.

FIG. 12 shows a representative example of the techniques discussed herein, illustrating the effects of application of dielectric material to an antenna system 1200. A representative antenna 1202 has a width of 100 mils and is configured to operate at 2.45 GHz. A dielectric block 1204 is located under the antenna 1202; that is, the dielectric block is located between the antenna 1202 and a ground plane 1206. A feed line 1208 drives the antenna 1202. In the example of FIG. 12, the antenna 1202 is supported 360 mils above the ground plane. The antenna's length is selected to properly resonate at 2.45 GHz. The matched antenna bandwidth (7 dB return loss or better) was 13.7%.

With the dielectric block removed (i.e., dielectric equal to air) the length of the antenna 1202 is 1040 mils. When the dielectric block 1204 had a dielectric constant of 10, the length of antenna 1202 was reduced to 700 mils, without degrading the matched bandwidth of 13.7%. The length and volume of the antenna 1202 (due to the dielectric 1204) was reduced to 67.3% of the original dimensions, as shown in Table 1. In this example, reduction of the antenna from 1040 mils to 700 mils provides a recovered area of 340 mils.

TABLE 1

Comparison of air and $\epsilon_r$ = 10 dielectric under 2.45 GHz main antenna arm

| $\epsilon_r$ | Area [mils$^2$] | Volume [mils$^3$] | Volume [%] | Area [%] | Length mils | Length [%] | BW [%] |
|---|---|---|---|---|---|---|---|
| air | 374400 | 37440000 | 100 | 100 | 1040 | 100 | 13.7 |
| 10 | 252000 | 25200000 | 67.3 | 67.3 | 700.0 | 67.3 | 13.7 |

FIG. 13 shows a further representative example of the techniques discussed herein, illustrating the effects of application of dielectric material to an antenna system 1300. The antenna system 1300 is altered from that seen in FIG. 12, in that 50% of the length under the antenna 1302 (between tip and feed 1308) is loaded with dielectric material 1304. Thus, a portion of the volume between the ground 1306 and antenna 1302 is dielectric-filled, and a portion is air-filled. The antenna 1302 is configured for operation at 2.45 GHz. A baseline antenna length (from which a "recovered area" may be obtained) is 1040 mils. When the dielectric material 1304 has a dielectric constant of $\in_r$=10, a length of the antenna becomes 750 mils, without impairing the usable antenna bandwidth. Accordingly, the antenna 1302, partially loaded by dielectric 1304, is 72.1% of the original antenna length (i.e., a length without dielectric 1304), and has the same performance as an antenna of length 1040 mil without dielectric loading. Accordingly, a recovered area having a length of 290 mils results.

If a dielectric constant of the dielectric material 1304 was changed to $\in_r$=30, a length of the antenna 1302 could be further reduced to a 575 mils, or a 55.3% of the length of an antenna without dielectric loading. This size reduction is achieved at an expense of usable antenna bandwidth, i.e., the bandwidth of the antenna is reduced to 8.6%. However, this result still considerably exceeds the required bandwidth for Bluetooth or Wi-Fi antennas at 2.45 GHz. Moreover, such a bandwidth reduction would also not be a problem for GPS antennas or other antenna applications where small percentage bandwidth is acceptable. This bandwidth reduction effect may constrain the use of very high dielectric constant materials (e.g. $\in_r$=30) in applications where very broadband antennas are required such as cellular pentaband antennas.

TABLE 2

Effect of placing dielectric loading at end of antenna arm

| $\epsilon_r$ | Area [mils$^2$] | Volume [mils$^3$] | Volume [%] | Area [%] | Length mils | Length [%] | BW [%] |
|---|---|---|---|---|---|---|---|
| air | 374400 | 37440000 | 100 | 100 | 1040 | 100 | 13.7 |
| 10 | 270000 | 27000000 | 72.1 | 72.1 | 750.0 | 72.1 | 13.7 |
| 30 | 207000 | 20700000 | 55.3 | 55.3 | 575.0 | 55.3 | 8.6 |

FIG. 14 shows a further representative example of the techniques discussed herein, illustrating the effects of application of dielectric material to an antenna system 1400. An antenna 1402, having a 100 mil wide PIFA antenna element, is supported above a ground plane 1406 and is feed by feed element 1408. A 635 mil long and 62 mil tall block of dielectric material 1404 is located on top of the antenna 1402. While some performance benefit was obtained with this approach (a length of antenna 1402 is reduced to 86.5% of an antenna not provided with dielectric loading), the benefits are slightly less impressive than for the other approaches demonstrated above.

TABLE 3

Effect of placing 62 mil thick dielectric block on top of antenna element

| $\epsilon_r$ | Area [mils$^2$] | Volume [mils$^3$] | Volume [%] | Area [%] | Length mils | Length [%] | BW [%] |
|---|---|---|---|---|---|---|---|
| air | 374400 | 37440000 | 100 | 100 | 1040 | 100 | 13.7 |
| 10 | 363370 | | | 97.1 | 900 | 86.5 | |

Conclusion

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A mobile device, comprising:

a ground plane, carried within an enclosure of the mobile device;

an antenna, carried within the enclosure of the mobile device;

dielectric loading material, fastened in a stacked relationship between at least a portion of the ground plane and at least a portion of the antenna; and a recovered area, sized as a function of the dielectric loading material, the recovered area located between the antenna and the enclosure, and sufficient in size to reduce adverse hand detuning of the antenna.

2. The mobile device as recited in claim 1, wherein the antenna comprises a flexible film printed circuit located along a carrier frame within which the dielectric loading material is contained.

3. The mobile device as recited in claim 1, wherein the antenna comprises a printed element pattern, the printed element pattern being printed on a carrier frame, the carrier frame supporting at least part of the ground plane.

4. The mobile device as recited in claim 1, wherein the recovered area comprises first and second recovered areas, and a relative size of the first and second recovered areas is controlled by a location on a printed circuit board to which a feed line of the antenna is connected.

5. The mobile device as recited in claim 1, further comprising:

a second dielectric loading material, located adjacent to the antenna, and on a side of the antenna opposite the dielectric loading material, to thereby sandwich at least a portion of the antenna between the dielectric loading material and the second dielectric loading material.

6. The mobile device as recited in claim 5, wherein portions of the ground plane, the antenna, the dielectric loading material and the second dielectric loading material are supported within the enclosure by a carrier frame.

7. The mobile device as recited in claim 1, wherein portions of the ground plane, the antenna and the dielectric loading material are located within a channel defined within a carrier frame within the enclosure of the mobile device.

8. The mobile device as recited in claim 1, further comprising:

a second dielectric loading material, the second dielectric loading material being located between the antenna and a portion of the enclosure nearest to the antenna.

9. A mobile device, comprising:

a printed circuit board to support components of the mobile device;

an antenna supported a distance from the printed circuit board;

a first dielectric loading material, contained within an area defined between the printed circuit board and the antenna;

a second dielectric loading material, located adjacent to the antenna, and on a side of the antenna opposite the first dielectric loading material, to thereby sandwich at least a portion of the antenna between the first dielectric loading material and the second dielectric loading material; and a recovered area that is sized as a function of the first and second dielectric loading materials, located between the antenna and an enclosure of the mobile device, and of sufficient size to reduce adverse hand detuning of the antenna.

10. The mobile device as recited in claim 9, wherein the antenna comprises a flexible film printed circuit carried by a carrier frame within which the first dielectric loading material is contained, and wherein the second dielectric loading material is supported on the carrier frame on the side of the antenna opposite the first dielectric loading material.

11. The mobile device as recited in claim 9, wherein the antenna comprises an element pattern printed on a carrier frame.

12. The mobile device as recited in claim 9, further comprising:

a recovered area, the recovered area sized in part as a function of sizes and positions of the first and second dielectric loading materials, the recovered area located between the antenna and an enclosure of the mobile device, the recovered area of sufficient size to allow operation of active components installed within the recovered area.

13. The mobile device as recited in claim 9, further comprising:

a third dielectric loading material, located between the antenna and a portion of an enclosure of the mobile device that is nearest to the antenna.

14. The mobile device as recited in claim 9, wherein the antenna is supported by a carrier frame and wherein the first dielectric loading material is located within a slot defined in the carrier frame.

15. A wireless communications device, comprising:

a ground plane, carried within an enclosure of the wireless communications device;

an antenna, carried within the enclosure of the wireless communications device;

a first dielectric loading material, contained within at least a portion of an area defined between the ground plane and the antenna;

a second dielectric loading material, located adjacent to the antenna, and on a side of the antenna opposite the first dielectric loading material; and a third dielectric loading material, located between the antenna and a portion of the enclosure nearest to the antenna and being sized to prevent adverse hand detuning that would result without the third dielectric loading material.

16. The wireless communications device as recited in claim 15, further comprising:

a recovered area, the recovered area sized as a function of the first, second and third dielectric loading materials, the recovered area located between the antenna and the enclosure, the recovered area of sufficient size to reduce adverse hand detuning of the antenna.

17. The wireless communications device as recited in claim 15, further comprising:

a recovered area, the recovered area sized as a function the first, second and third dielectric loading materials, the recovered area of sufficient size to allow active components installed within the recovered area.

18. The wireless communications device as recited in claim 15, wherein the antenna comprises a flexible film printed circuit carried by at least one side of a carrier frame within which the first dielectric loading material is contained, and wherein the second dielectric loading material is located on a side of the antenna opposite the first dielectric loading material.

* * * * *